United States Patent [19]

Rose et al.

[11] Patent Number: 4,496,802

[45] Date of Patent: Jan. 29, 1985

[54] SINGLE IN-LINE PACKAGE SWITCH

[75] Inventors: William H. Rose; David T. Shaffer, both of Harrisburg, Pa.

[73] Assignee: AMP Incorporated, Harrisburg, Pa.

[21] Appl. No.: 485,549

[22] Filed: Apr. 15, 1983

[51] Int. Cl.[3] ..... H01H 5/18

[52] U.S. Cl. ..... 200/5 R; 200/6 R; 200/67 DB

[58] Field of Search ..... 200/6 R, 6 A, 6 B, 6 BA, 200/6 BB, 6 C, 67 D, 67 DB, 159 A, 284, 275, 200/5 R

[56] References Cited

U.S. PATENT DOCUMENTS

| | | | |
|---|---|---|---|
| 3,067,301 | 12/1962 | Yamamoto | 200/67 DB |
| 3,548,131 | 12/1970 | Piber | 200/275 X |
| 4,059,737 | 11/1977 | Gergaud | 200/159 A X |
| 4,417,106 | 11/1983 | Gingerich et al. | 200/6 R X |

*Primary Examiner*—A. D. Pellinen
*Assistant Examiner*—Morris Ginsburg
*Attorney, Agent, or Firm*—Adrian J. LaRue

[57] ABSTRACT

A single in-line package switch comprises a dielectric frame along which movable electrical contact members are disposed. An electrical bus contact is mounted on support members of the dielectric frame, each of the movable contact members extending between a pair of the support members. Each of the movable contact members has a sinusoidal contact section, one end of the contact section being secured in the dielectric frame as a terminal section while the free end of the contact section is disposed within a recess of an actuating member pivotally mounted on the pair of support members between which the contact section is disposed. A housing member is secured onto the dielectric frame with actuating sections of the actuating members being operable from one surface of the housing member to one position thereby moving the sinusoidal contact sections in electrical engagement with the bus contact and to another position thereby moving the sinusoidal contact sections free of the bus contact, the spring forces of the sinusoidal contact sections maintaining the contact sections and the actuating members in the one or the other position.

12 Claims, 11 Drawing Figures

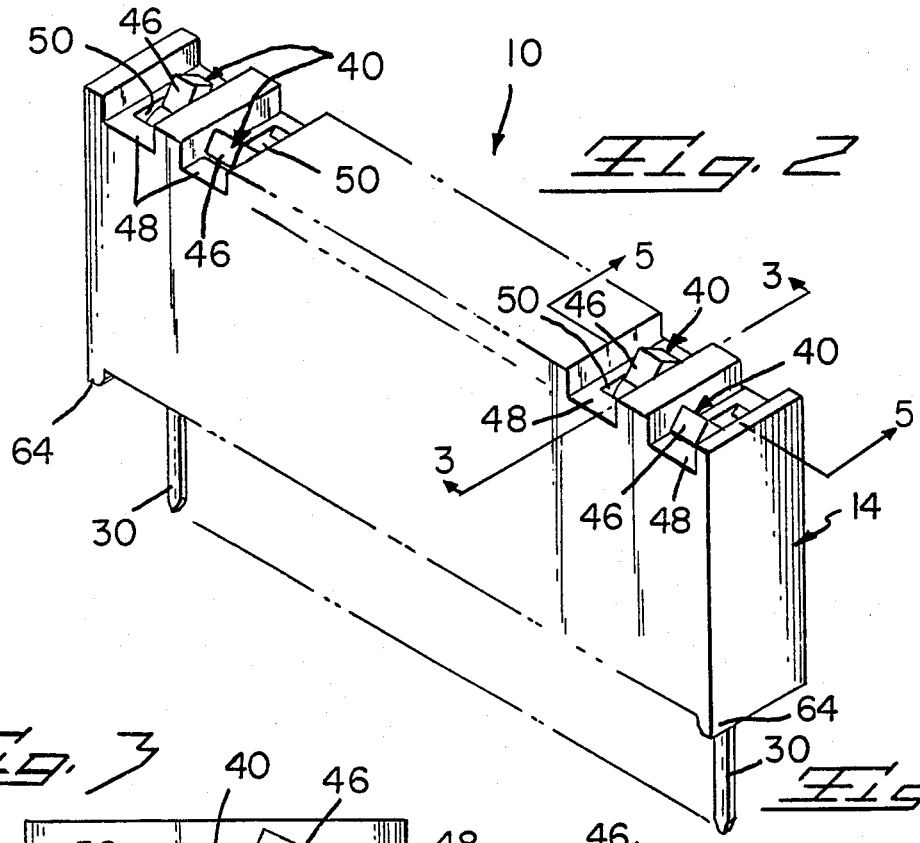
Fig. 2
Fig. 3
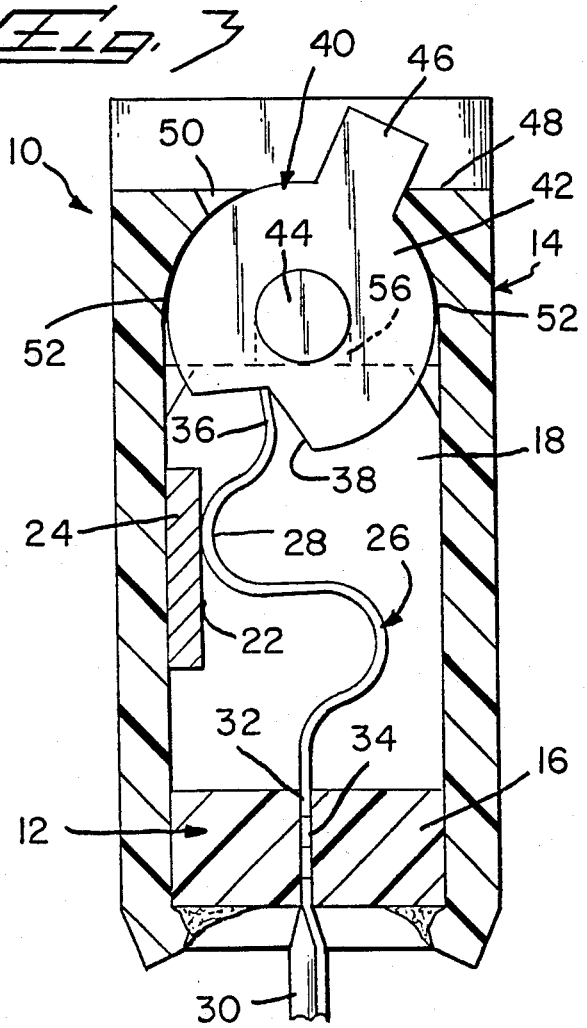
Fig. 4
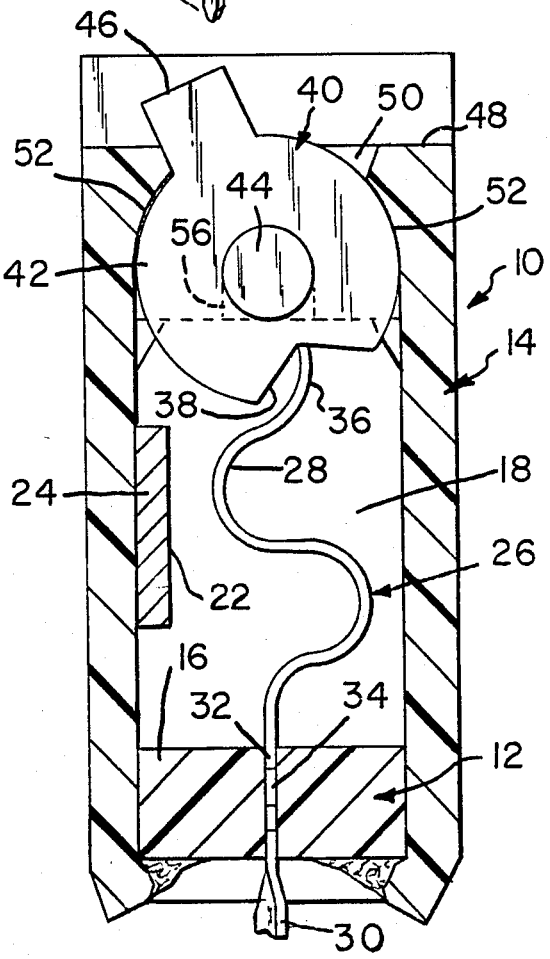

WITH ALL POSITIONS OPEN HEX 1 1 1 0 1 1 1 1 EF

WITH POSITION 4 CLOSED HEX 1 1 1 0 1 1 1 1 EF

WITH POSITIONS 5,4,2 & 0 CLOSED HEX 1 1 0 0 1 0 1 0 CA

WITH POSITIONS 7,4 & 2 CLOSED HEX 0 1 1 0 1 0 1 1 6B

SINGLE IN-LINE PACKAGE SWITCH

FIELD OF THE INVENTION

This invention relates to switches and more particularly to single in-line package (SIP) switches.

BACKGROUND OF THE INVENTION

At present, codes between integrated circuits on circuit boards can be changed by use of posts electrically connected to a ground plane and a voltage level. This is done when space on circuit boards is a problem and this problem is becoming prevalent by virtue of more components being utilized on circuit boards due to increasing demand for additional circuit requirements to perform more functions.

The use of posts does not present the most desirable way to the selection and changing of codes between the various integrated circuits as this is a cumbersome arrangement that uses electrical wires which must be mechanically and electrically connected to the posts and the selected pins of the integrated circuits. If the codes are to be changed, the wires must be reconnected so that the electronic circuits will operate as required.

Dual in-line package switches can be used when no space problems on the circuit boards exist; but if space is a problem, then a smaller switch with multiple actuating members would enable selection and changing of codes to be readily effected without the use of cumbersome posts and electrical wires as heretofore used.

SUMMARY OF THE INVENTION

According to the present invention, a single in-line package switch comprises a dielectric frame along which movable electrical contact members are disposed. An electrical bus contact is mounted on support members of the dielectric frame, each of the movable contact members extending between a pair of the support members. Each of the movable contact members has a sinusoidal contact section, one end of the contact section being secured in the dielectric frame as a terminal section while the free end of the contact section is disposed within a recess of an actuating member pivotally mounted on the pair of support members between which the contact section is disposed. A housing member is secured onto the dielectric frame with actuating sections of the actuating members being operable from one surface of the housing member to one position thereby moving the sinusoidal contact sections in electrical engagement with the bus contact and to another position thereby moving the sinusoidal contact sections free of the bus contact, the spring forces of the sinusoidal contact sections maintaining the contact sections and the actuating members in the one or the other position.

BRIEF DESCRIPTION OF THE DRAWINGS

FIG. 2 shows the switch of FIG. 1 in an assembled form.

FIG. 3 is a cross-sectional view taken along line 3—3 of FIG. 2 showing one of the movable electrical contact sections of the switch in an actuated position.

FIG. 4 is a view similar to FIG. 3 showing the movable electrical contact section in a nonactuated position.

DETAILED DESCRIPTION OF THE INVENTION

FIGS. 1 through 5 illustrate the switch 10 which is a single in-line package (SIP) switch for use on circuit boards to allow codes to be easily set at the factory or in the field as required. Switch 10 includes a dielectric frame 12 and dielectric housing member 14. Dielectric frame 12 and dielectric housing member 14 are molded from a suitable plastic material.

Figure 1:
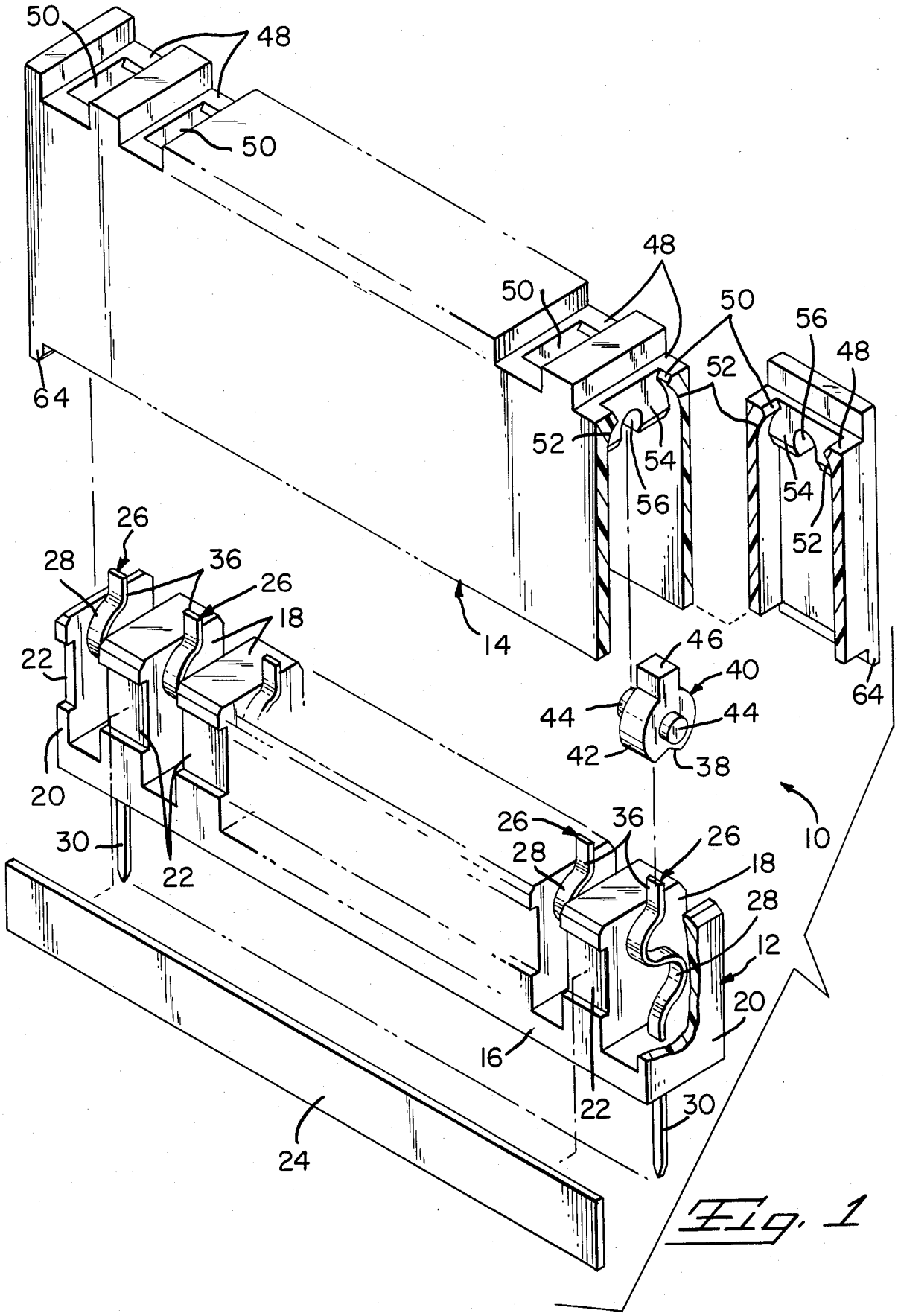
FIG. 1 is an exploded perspective view of the parts of the SIP switch with one of the parts having a broken away section and another of the parts being in cross section and the end exploded therefrom.
Figure 5:
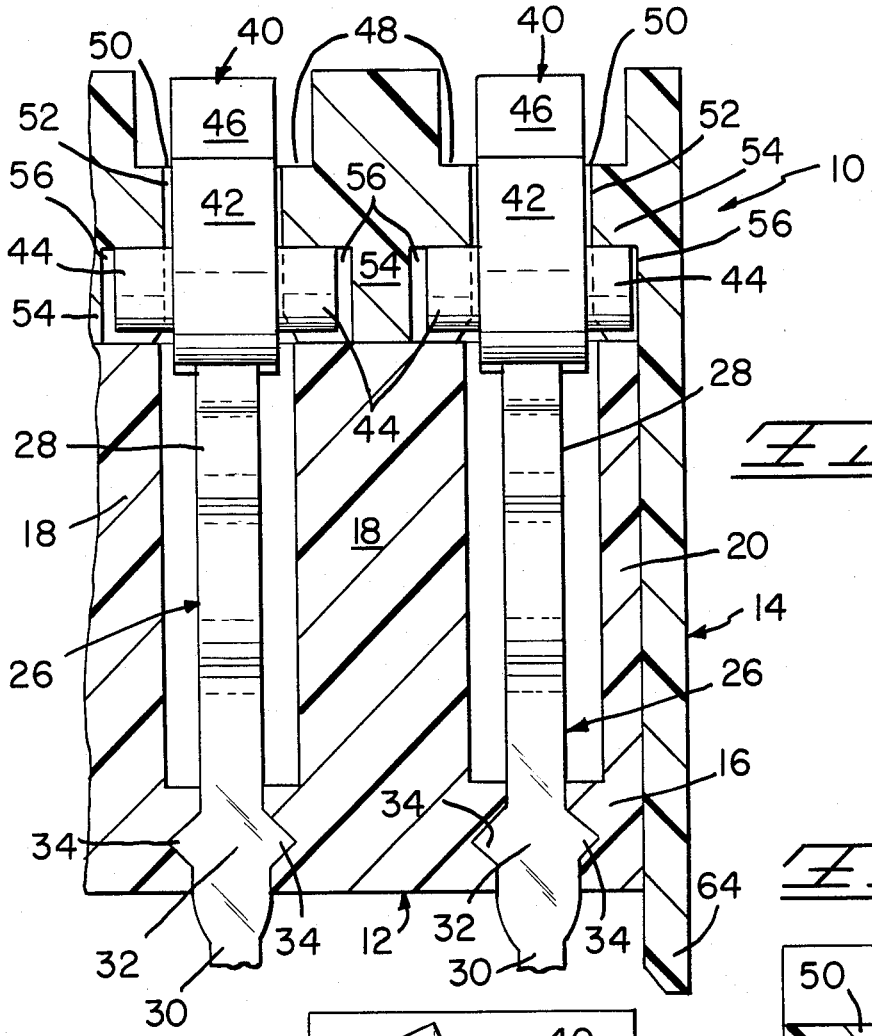
FIG. 5 is a cross-sectional view taken along line 5—5 of FIG. 2.

Dielectric frame 12 has a base 16 from which extend support members 18 at spaced intervals therealong. End support members 20 are thinner than support members 18 as shown in FIGS. 1 and 5. A recess 22 is located in each of support members 18 and 20. An electrical bus contact member 24 is disposed in recesses 22 of support members 18 and 20 and is held in position therein by means of housing member 14 as shown in FIGS. 3 and 4.

Movable electrical contact members 26 are stamped and formed from a suitable metal having desirable spring characteristics and include a contact section 28, a terminal section 30, and a securing section 32. Movable contact members 26 are molded in position within dielectric frame 12 between support members 18 and 20 via securing section 32 which includes triangular-shaped projections 34 which are best illustrate in FIG. 5 and which enhance the securing of movable contact members 26 in position in base 16 of dielectric frame 12 when they are molded in position during the molding of dielectric frame 12. Terminal sections 30 are formed slightly and extend outwardly therefrom for electrical connection with conductive paths on a circuit board in accordance with normal flow-soldering practices or they can be securd in sockets electrically connected to the conductive paths as desired.

Contact sections 28 are of sinusoidal configuration or an S-shape or with double curved sections. One end of contact sections 28 extends outwardly from securing sections 32 whereas free ends 36 of contact sections 28 are disposed within notched areas 38 of actuating members 40. As can be discerned, free ends 36 are disposed at the apex of notched areas 38.

Actuating members 40 are molded from a suitable plastic material and have almost circular sections 42 in which notched areas 38 are located and from the sides of which extend circular pivot members 44. Projections 46 extend outwardly from circular sections 42 opposite notched areas 38.

Housing member 14 has a series of recesses 48 located in a top surface thereof. Slots 50 are located in the bottom surfaces of recesses 48 and communicate with the interior of housing member 14. As shown in FIGS. 1, 3, 4, and 6, the inside surfaces of housing member 14 have arcuate sections 52 that merge with the respective ends of slots 50 and along which circular sections 42 of actuating members 40 extend. Projections 54 extend inwardly from the top surface of housing member 14 in alignment with support members 18 and 20 and have arcuate recesses 56 therein to accommodate pivot members 44 of actuating members 40 enabling actuating members 40 to be pivotally moved thereabout.

In assembly, a lead frame (not shown) containing stamped and formed movable contact members 26 thereon is positioned in a mold whereafter dielectric frame 12 is molded therein with contact members 26 positioned between adjacent support members 18 and end support members 20 and adjacent support members 18. Bus contact member 24 can also be molded in position in dielectric frame 12 or it can be frictionally positioned within recesses 22 formed in support members 18 and 20. Housing member 14 is positioned in an upside-down position so that actuating members 40 are positioned in adjacent projections 54 with pivot members 44 disposed within arcuate recesses 56, circular sections 42 disposed in engagement with arcuate sections 52, and projections 46 extending through slots 50 within recesses 48. Dielectric frame 12 containing movable contact members 26 and bus contact member 24 therein is inserted within housing member 14 with the upper surfaces of support members 18 and 20 engaging against the bottom surfaces of respective projections 54 and with free ends 36 of movable contact members 26 disposed against the apexes within respective notched areas 38 of actuating members 40 whereafter heat is applied to the bottom edges of housing member 14 to deform them into engagement with base 16 as shown in FIGS. 3 and 4 thereby securing dielectric frame 12 in position in housing member 14.

Figure 6:
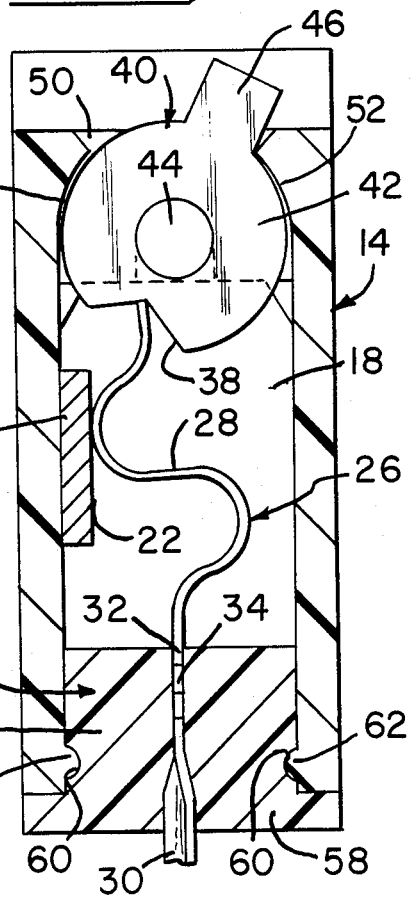
FIG. 6 is a cross-sectional view of an alternative embodiment.

If desired, as shown in FIG. 6, a T-shaped member 58 having recesses 60 in the sides thereof which are matable with projections 62 on the inside surfaces of housing member 14 is positioned in the bottom of housing member 14 thereby maintaining member 58 in position in housing member 14 and in turn engages base 16 of dielectric frame 12 thereby maintaining dielectric frame 12 in position in housing member 14. An adhesive, if desired, can be applied onto the sides of member 58 and along the adjacent surfaces thereby adhesively securing member 58 in position in housing member 14 as shown in FIG. 6. Projections 64 extend outwardly from base 16 at the ends of housing member 14 which engage the circuit board when switch 10 is inserted in position thereon to space switch 10 from the surface of the circuit board.

Figure 7:
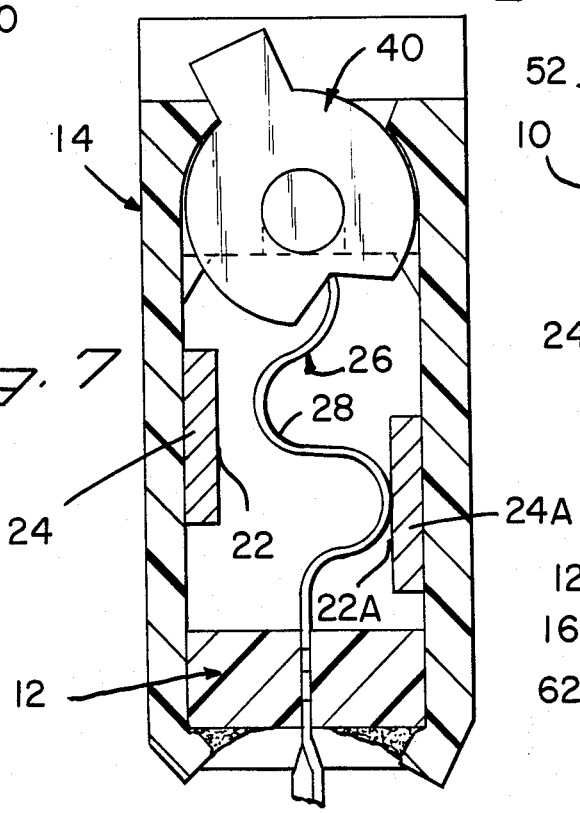
FIG. 7 is a cross-sectional view of a further embodiment.

When dielectric frame 12 is secured in position in housing member 14 with free ends 36 of movable contact members 26 disposed at the apexes of notched areas 38 of actuating members 40, the spring forces of contact sections 28 urge pivot members 44 against the bottoms of arcuate recesses 56 and also maintain actuating members 40 in either an actuated position as shown in FIG. 3 with a curved section of contact section 28 in electrical engagement with bus contact member 24 or in a nonactuated position as shown in FIG. 4 with contact section 28 completely free of engagement with bus contact member 24. Projections 46 enable an operator to move actuating members 40 to actuated or nonactuated positions. The action of double-curved contact sections 28 is such as to provide snap-action operation to actuating members 40 such that when projections 46 are moved beyond their center locations, they will snap into an actuated or nonactuated position depending upon which direction actuating members 40 are being moved. Accordingly, if projections 46 do not move beyond their center positions, they will return to the positions they were located in as a result of the spring forces of contact sections 28. The spring forces of contact sections 28 act eccentrically on actuating members 40 to maintain them in actuated or nonactuated positions. The pivot points of contact sections 28 are located along the bottom curved portions. Thus, the switch as illustrated in FIGS. 1 through 6 is either in the actuated or nonactuated position depending upon the positions of actuating members 40. If desired, another bus contact member 24A can be disposed in recesses 22A in support members 18 and 20 opposite the bottom curved sections of contact sections 28 to enable switch 10 to be able to operate between two voltage levels if necessary as shown in FIG. 7.

Figure 8:
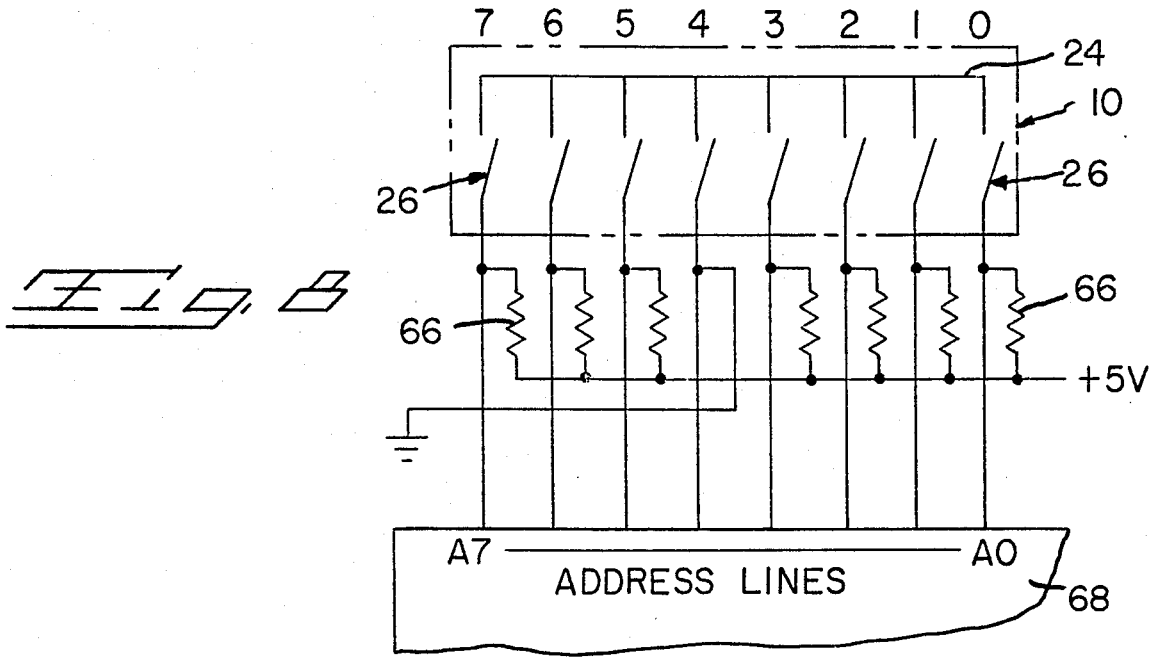
FIGS. 8 through 11 are schematic diagrams illustrating several codes that can be established by use of the SIP switch.

FIG. 8 shows a SIP switch 10 that has its movable contact members 26 electrically connected to respective address lines A0 through A7 of a circuit board 68. Movable contact members 26 representing switch positions 0, 1, 2, 3, 5, 6, and 7 are respectively connected to a +5 voltage via resistors 66 and the movable contact member representing position 4 is connected to ground. With all of the switch positions open, the code being generated to the address lines will be 1 1 1 0 1 1 1 1 as shown in FIG. 8.

Figure 9:
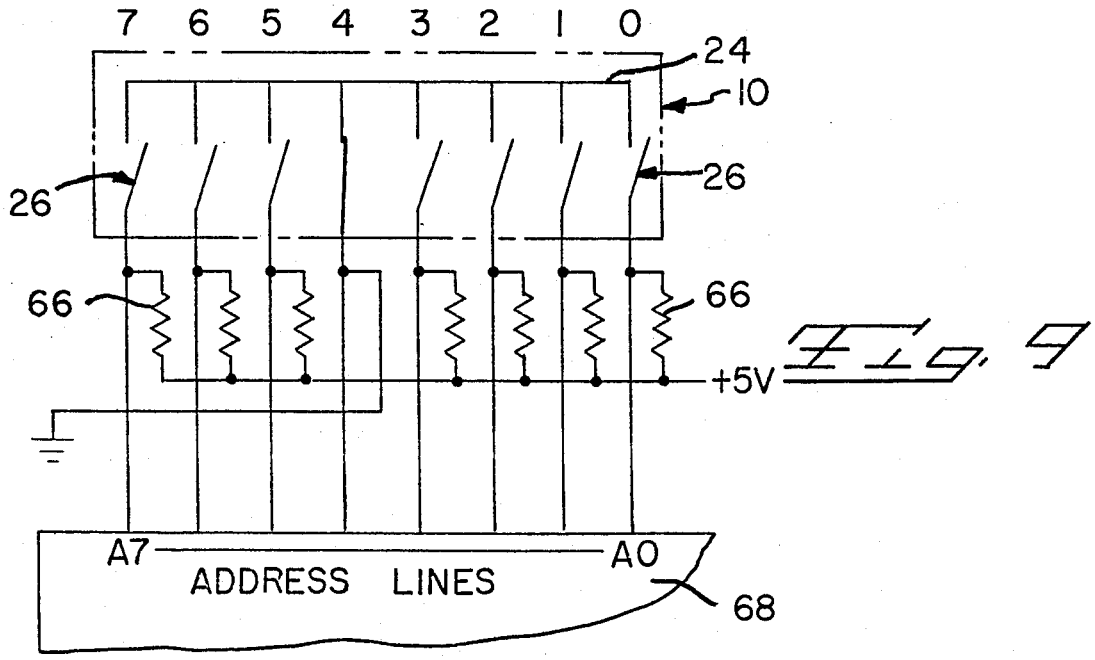
Figure 10:
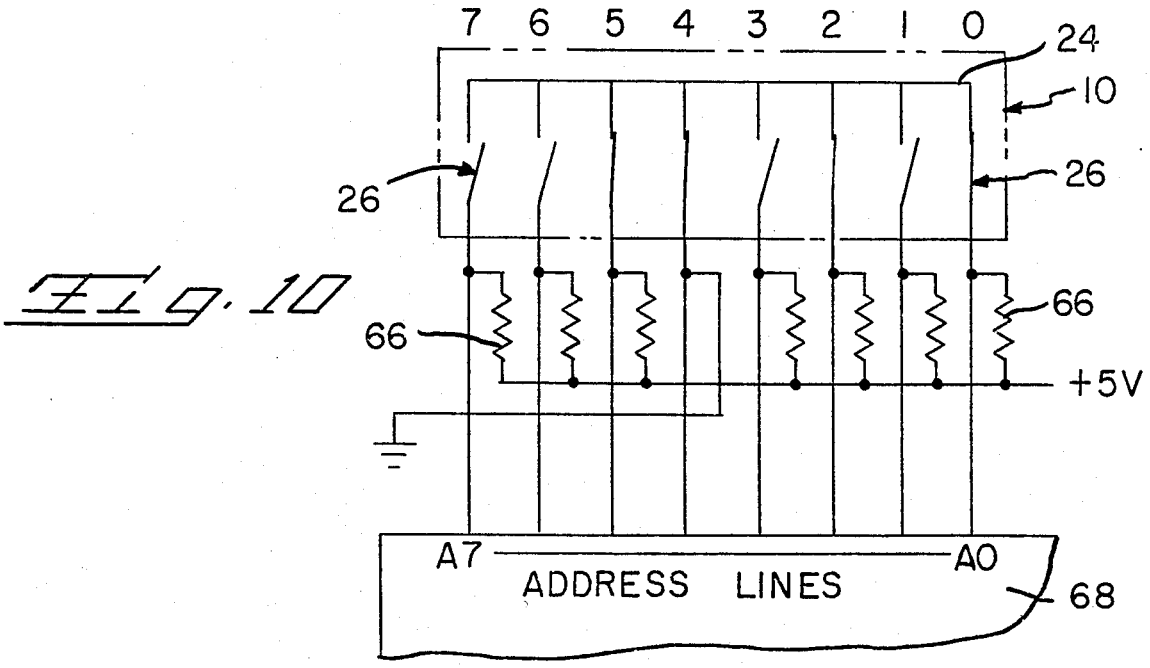
Figure 11:
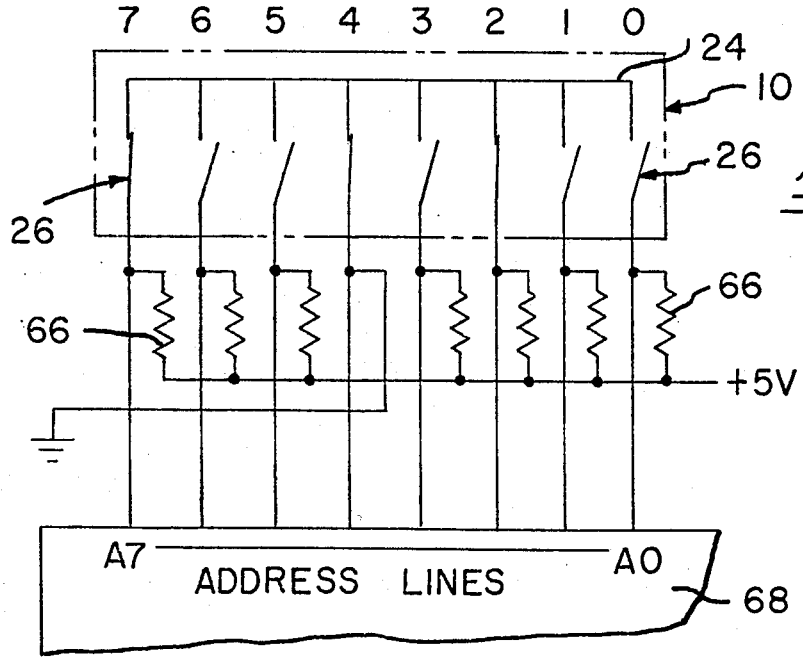

As shown in FIG. 9, with position 4 of switch 10 closed with movable contact member 26 electrically connected to bus contact 24, the code being sent out to address lines A0 through A7 will be 1 1 1 0 1 1 1 1. As shown in FIG. 10, with movable contact members 26 in positions 5, 4, 2, and 0 electrically connected to bus contact 24, the code being generated over address lines A0 through A7 will be 1 1 0 0 1 0 1 0. As shown in FIG. 11, with movable contact members 26 electrically connected to bus contact 24 in positions 7, 4, and 2, the code appearing on address lines A0 through A7 will be 0 1 1 0 1 0 1 1. Thus, FIGS. 8 through 11 are representative of some of the codes that can be established by use of SIP switch 10. An eight-position SIP switch will enable 128 codes to be selected.

The SIP switch of the present invention allows the code to be easily set at the factory or in the field as required. This enables on-board option selection where extreme density problems on boards are being experienced. The bottom of the switch is sealed by virtue of the movable contact members 26 being molded in position in frame 12 and with base 16 being heat-staked in position in housing member 14. Top sealing can take place by applying a peelable sealing material along the top surface of housing member 14 which extends into recesses 48 and slots 50 surrounding projections 46 and circular sections 42. SIP switch 10 is of small size, can be stackable in end-to-end relationship, and may be machine insertable onto circuit boards.

We claim:

1. An electrical switch of the type comprising a dielectric frame in which movable electrical contact members are mounted in actuating alignment with a stationary electrical contact member, actuating members in engagement with respective free ends of the movable contact members, and a housing member mounted on the dielectric frame, characterized in that:

each of said movable contact members has a reverse-curved contact section, the free end of said reverse-curved contact section disposed in a recess of a respective one of said actuating members;

said stationary electrical contact member mounted onto said dielectric frame and defining a bus contact member;

said actuating members when moved to one position moving the movable contact sections into electrical engagement with said bus contact member, said actuating members when moved to another position moving the movable contact sections free of the bus contact member, the spring forces of the reverse-curved contact sections maintaining the movable contact sections and actuating members in the one or the other position.

2. An electrical switch as set forth in claim 1, wherein said reverse-curved contact sections are of a sinusoidal configuration.

3. An electrical switch as set forth in claim 1, wherein said movable contact members have terminal sections extending outwardly from said dielectric frame.

4. An electrical switch as set forth in claim 1, characterized in that said dielectric frame has spaced support members between which said movable contact members are mounted, said support members having recesses in which the bus contact member is disposed.

5. An electrical switch as set forth in claim 4, characterized in that said housing member has projections extending inwardly from an upper end in alignment with respective ones of said support members, said dielectric frame has a base in which securing sections of said movable contact members are mounted, said base being secured in said housing member with said support members in engagement with respective projections.

6. An electrical switch as set forth in claim 5, characterized in that said projections have arcuate recesses, said housing member has slots extending through said upper end, said actuating members having pivot sections disposed in said arcuate recesses and projection members extend through said slots to move the actuating members from the one to the other position.

7. An electrical switch as set forth in claim 6, characterized in that said actuating members have part circular sections containing said recess in the form of a notched area, said free ends of said contact sections being disposed at an apex of said notched area, spring forces of said contact sections maintaining said pivot sections in said arcuate recesses.

8. An electrical switch as set forth in claim 1, characterized in that another bus contact member is mounted onto said dielectric frame which is electrically engaged by said movable contact sections in the other position.

9. An electrical switch, comprising: dielectric frame means having base means from which extend support means at spaced locations therealong;

bus contact means mounted onto said support means;

movable contact means having securing section means in said base means and contact section means disposed between adjacent ones of said support means, said contact section means having free end means and reverse-curved portions, one of said reverse-curved portions disposed in alignment with said bus contact means;

housing means covering said dielectric frame means and secured thereto, said housing means having slot means in alignment with said movable contact means; and actuating means movably mounted between said support means and said housing means and including projection member means extending through said slot means for operating said actuating means, said actuating means having notch means in which free end means of said contact section means is disposed, said contact section means applying spring forces onto said actuating means and maintaining said actuating means in one position with the one of the curved portions in electrical engagement with said bus contact means and in another portion with said contact section means free of said bus contact means.

10. An electrical switch as set forth in claim 9, wherein said contact section means has a sinusoidal configuration.

11. An electrical switch as set forth in claim 9, wherein said housing means has projection means in engagement with said support means, said projection means having arcuate recess means, said actuating means having pivot means disposed in said arcuate recess means.

12. An electrical switch as set forth in claim 9, wherein another bus contact means is disposed in said support means in alignment with the other of said reverse-curved portions and is electrically engageable therewith when said actuating means is in the other position.

* * * * *